United States Patent [19]

Hildebolt

[11] Patent Number: 4,522,015

[45] Date of Patent: Jun. 11, 1985

[54] PHASED ASEPTIC STERILIZATION AND PACKAGING PROCESS AND SYSTEM

[75] Inventor: William M. Hildebolt, Mickleton, N.J.

[73] Assignee: Campbell Soup Company, Camden, N.J.

[21] Appl. No.: 456,248

[22] Filed: Jan. 6, 1983

Related U.S. Application Data

[63] Continuation of Ser. No. 221,850, Dec. 31, 1980, abandoned.

[51] Int. Cl.[3] ..... B65B 55/02

[52] U.S. Cl. ..... 53/425; 53/407; 53/408; 422/26; 426/399

[58] Field of Search ..... 53/425, 407, 408, 403; 422/26, 297, 302; 426/399, 400, 401, 402, 403, 407, 412; 99/359

[56] References Cited

U.S. PATENT DOCUMENTS

| | | | |
|---|---|---|---|
| 273,436 | 3/1883 | Baker | 426/399 |
| 1,114,023 | 10/1914 | Olney | 422/302 |
| 1,803,605 | 5/1931 | Fitzgerald | 426/404 |
| 2,380,984 | 8/1945 | Moeller | 226/68 |
| 2,447,240 | 8/1948 | Eisler | 99/359 |
| 2,997,397 | 8/1961 | Doulgheridis | 426/399 |
| 3,232,770 | 2/1966 | Schack et al. | 426/401 |
| 3,241,475 | 3/1966 | Schack et al. | 99/470 |
| 3,437,495 | 4/1969 | Jeppson | 426/399 |
| 3,603,240 | 9/1971 | McCarthy | 99/359 |
| 3,875,318 | 4/1975 | Davies | 426/399 |
| 4,148,933 | 4/1979 | Janovtchik | 426/402 |
| 4,156,741 | 5/1979 | Beauvais et al. | 426/131 |

OTHER PUBLICATIONS

V. R. Carson, *Aseptic Processing,* Technical Digest cb-201, 4th Ed., Cherry-Burrell Corp., Mar. 1971.

*APV Uperisation,* Publication A408d, A.P.V. Company Ltd., West Sussex, England 1979.

*APV Jupiter System for Sterilising Food Materials Containing Solids,* Publication A512, APV Holdings Ltd., West Sussex, England, 1980.

J. Green, "A Closer Look at Aseptic Canning", H. J. Heinz Co., Ltd., Great Britain, from *Food Engineering,* Mar. 1978.

"Launches Pilot Plant for Aseptic Processing", from *Food Engineering,* Aug. 1973.

*Primary Examiner*—James F. Coan

*Attorney, Agent, or Firm*—Banner, Birch, McKie & Beckett

[57] ABSTRACT

A phased aseptic sterilization and packaging process is disclosed wherein the solid component of a product is separately sterilized within the container in which the product is ultimately sealed. The liquid component is aseptically sterilized independently, and is aseptically filled into the container in a chilled condition to quench the hot solid component prior to final sealing of the container. A novel apparatus is provided for handling the containers during processing.

21 Claims, 10 Drawing Figures

PHASED ASEPTIC STERILIZATION AND PACKAGING PROCESS AND SYSTEM

This is a continuation of application Ser. No. 221,850, filed Dec. 31, 1980, and now abandoned.

FIELD OF THE INVENTION

The invention relates to sterilization and packaging of food products having solid and liquid components. More particularly, the present invention relates to a sterilization and packaging process and system in which the solid components of the food product are sterilized in the ultimate product container separately from the liquid components, which are sterilized and aseptically filled into the container.

BACKGROUND OF THE INVENTION

"Canning" food products involves the packing of food in rigid, sealed containers, usually metal or glass, under conditions which permit the packaged item to be indefinitely shelf stable at normal room temperatures. Generally, canned food products have exhibited characteristic heat processed flavors and inferior texture and/or color to the consumer. With the advent of improved transportation and distribution of fresh foods, and the widespread use of other food preservation techniques, such as freezing, the inferior flavor, texture and color of canned products have become, by comparison, more noticeable to the consuming public. In some instances this factor is thought to have contributed to consumer rejection of otherwise wholesome and stable canned items.

The heat processed flavors are encountered in both meat and vegetable products. Certain of the inferior flavors result from the food preparation method and are identified as "cooked in the can" or "processed" flavors. These are promoted by at least two conditions encountered in prior art canning operations, namely, overcooking and cooking in a sealed container in the presence of relatively large portions of liquid diluting material which is normally canned with the garnish. These heat processed flavors are distinct from the metallic taste sometimes imparted to food packed in metal cans, the latter being a characteristic of the container rather than the food preparation.

In the usual canning process the cans are filled with the garnish and liquid components, sealed, and retorted either continuously or in large batches. Retorting, while primarily intended to sterilize the product, also cooks it within the sealed can. It cannot be said that all bacteria and spoilage organisms are destroyed during retorting, but commercially acceptable and nutritionally safe sterilization levels may be obtained by holding the product at elevated temperatures for periods of time inversely proportional to the temperature. That is, generally, at higher temperatures, shorter periods of time are lethal for a sufficient percentage of bacteria to effect sterilization. Reference is directed to the National Canners Association "Laboratory Manual for the Canning Industry," 2d edition, 1956, for further information on temperature and time requirements to effect sterilization in the canning process.

Temperatures must be held within practical limits to avoid excessive thermal damage to the product, and to avoid excessive stresses upon the cans. Unfortunately, in the retorting process the time and temperature conditions necessary to effect sterilization also result in over treatment of at least portions of the food product. In this regard it must be noted that heat transfer within the sealed can will result in the outer portions of the product reaching relatively high temperatures for longer periods as contrasted with the inner portions. Consequently, thermal degradation primarily of the liquid component of the product occurs.

Additionally, the heating of a garnish in the presence of large amounts of liquid component, usually water, also appears to impair flavor or taste values of the product primarily due to loss of flavor material to the liquid and to losses associated with chemical reactions. The rates of these chemical reactions increase as the temperature increases. This effect is similar to cooking in excess water or boiling often employed by the homemaker with tough or poor quality foods. Furthermore, when food products are cooked in a closed container or vessel, any undesirable volatile materials which would normally escape in home cooking will be retained within the product, probably in the diluting agent.

The conventional retorting process, in addition to impairing certain flavor values, is also highly energy inefficient, since it requires large batches of canned product to be placed in a retort vessel, which is then raised to a superatmospheric pressure and elevated temperature for a time sufficient for all of the product within each can to reach and hold a given temperature until sterilized. The energy required to accomplish this result is more than that required to sterilize the components individually. Further, the cans must be cooled and the pressure within the retort reduced before the latter may be opened and the cans removed. This requires costly and space consuming cooling equipment.

In an attempt to overcome the disadvantages of retorting, the canning industry has directed much interest to processes for aseptically sterilizing food products before can filling. Aseptic sterilization of foods refers to the sterilization of foods under sterile environmental conditions within a particular field or area, and usually involves techniques for keeping micro-organisms from the area. This contrasts with the above-described retorting method, wherein unsterilized food is placed within an unsterile container in an unsterile environment and is subsequently heated to commercially sterilize the contents. Aseptic methods have been employed primarily with food products containing no suspended particles or garnish, such as fruit juices or milk products. The prior art has described processes in which the garnish and liquid components of the product are separately, aseptically sterilized and are delivered to a sterile container for final packaging. (See, e.g., U.S. Pat. Nos. 3,232,770, 3,241,475, and 3,437,495). Because the garnish is sterilized outside of the ultimate container, considerable handling of the delicate garnish is required after sterilization by heating in order to deliver to the ultimate container. In the case of many types of delicate garnish, it has been found that this handling results in considerable physical damage to the garnish.

In Baker U.S. Pat. No. 273,436, a process for canning green corn on the cob is disclosed which involves placing the corn and a very small quantity of water into a can, sealing the can, heating the can to flash the water into steam, which cooks and sterilizes the corn, opening the can and filling it with brine, and resealing the can and heating the can again. While this process serves to better preserve the tenderness and flavor of the corn itself, inherent in the process is a degradation of the product due to the secondary heating of the product with the brine in the can.

SUMMARY OF THE INVENTION

It is an object of the present invention to provide a process and system for the sterilization and packaging of food products containing solid and liquid components which does not suffer the disadvantages of the prior art.

More specifically, it is an object of the present invention to provide a sterilization and packaging process and system which produces a multicomponent product in which each component has its own distinguishable flavor and texture.

It is also an object of the present invention to provide a process and system for sterilizing and packing multicomponent food products which results in a more efficient utilization of energy by separately sterilizing the components in the most effective manner.

A further object of the present invention is to provide a process and system for the sterilization and packaging of multicomponent food products in which the rehydration of carbohydate components such as pastas, rice, and beans can be controlled within optimum values during the sterilization process.

Another object of the present invention is to provide a process and system for the sterilization and packaging of multicomponent food products in which conventional starch based suspension agents may be omitted from the product formulation with attendant decreases in heating requirements and in cost, and increases in the quality of product flavor and texture.

These and other objects of the invention, which will be apparent from the following description, are achieved by providing a method for sterilizing and packaging a product having solid and liquid components, comprising steps of placing the unsterilized solid component into a container in which the product is ultimately sealed; temporarily closing the container; heating the contents of the container to effect sterilization thereof; opening the container in a pressurized, sterile environment, to prevent contamination and flashing of the contents; filling the container with aseptically sterilized liquid component which is cooler than the solid component to quench the hot solid component; and sealing the filled container. A small quantity of water may be placed in the container with the solid component prior to heating. The water will flash to steam when heated to more efficiently sterilize the solid component.

In a preferred method of carrying out the invention, the open-ended container in which the product is ultimately sealed may be inserted into a close-fitting, open-ended processing chamber, which is fitted with a lid which also temporarily closes the open end of the container. With such an arrangement, the entire container and processing chamber may be heated to effect sterilization of the solid components. After heating, the lid can be removed to permit addition of the aseptically sterilized liquid component.

The invention also comprises a system for sterilizing and packaging a food product having solid and liquid components comprising means for inserting the unsterilized solid component into the container in which the product is ultimately sealed; means for temporarily sealing and handling the container during immersion thereof in sterilizing zone containing a heating medium in which the container and its contents are sterilized; means for aseptically sterilizing the liquid component; means for cooling the aseptically sterilized liquid component; means for aspectically filling the sterilized container in sterile environment with sterilized and cooled liquid component to quench the hot solid component; and sealing means for permanently sealing the filled container.

The preferred system includes the above-described processing chamber and lid. The bottom of the chamber may be provided with an aperture opposite the open end thereof through which pusher means extend to partially eject the container from the chamber to facilitate application of a permanent lid to the open end of the container after all the components of the product have been inserted.

BRIEF DESCRIPTION OF THE DRAWINGS

The details of the invention are described in detail below in connection with the accompanying drawings, in which.

DESCRIPTION OF THE INVENTION

In the description that follows the process and apparatus are described in connection with the sterilization of food products having a solid component and a liquid component, and packaging these products into cans. It is to be understood, however, that the process and apparatus of the invention are suitable for sterilizing other types of foods having diverse components, and packaging the product in any suitable container. The process and apparatus is also suitable for heat treating and packaging any type of product in any suitable container wherein separate components of the product require separate treatment.

The term "garnish" as used in the specification and claims is intended to refer to any solid or particulate edible food product. Included inter alia, in this class of materials are meat products, vegetables, fruits, pasta products, and the like. Typically, the "liquid" component of food products processed according to the present invention can include sauces, broths, gravies, and the like and may also include slurries containing suspended solids.

Figure 1:
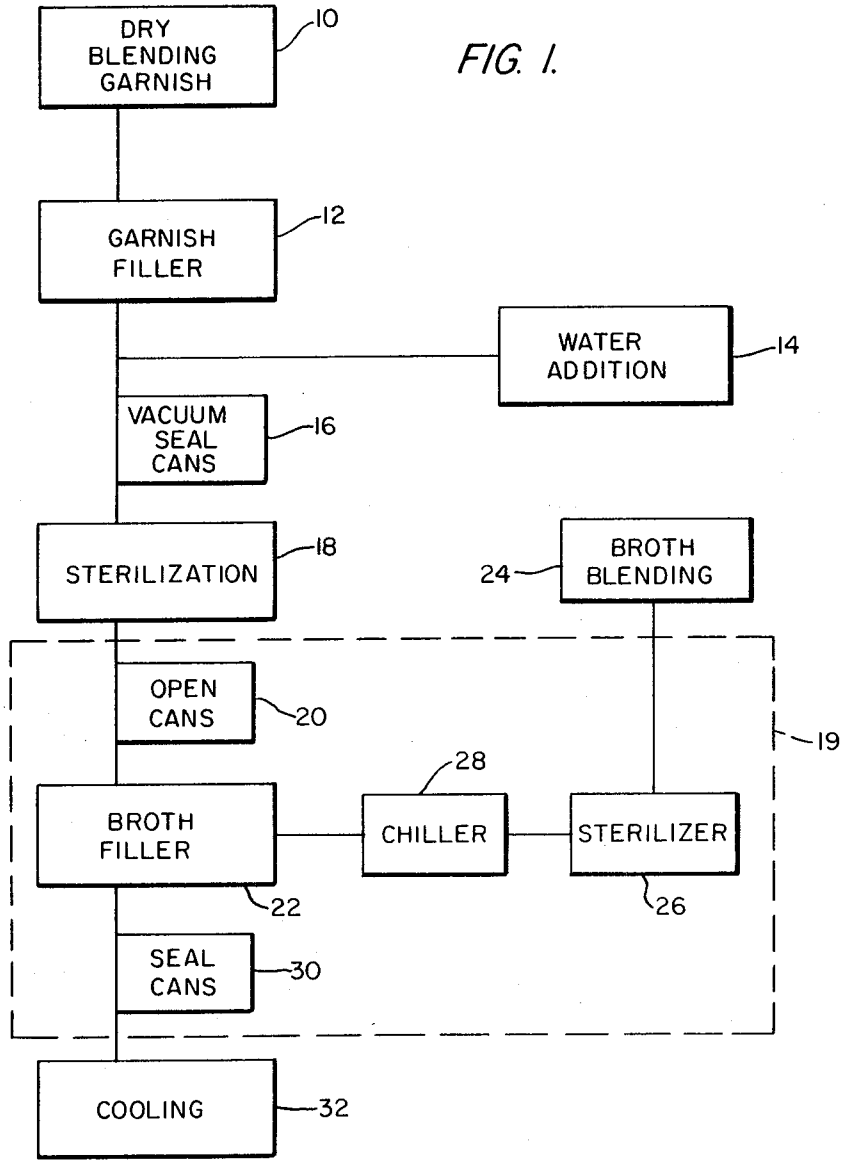
FIG. 1 is a schematic illustration of one embodiment of the phased aseptic sterilization and packaging process of the present invention.

Referring to FIG. 1, which illustrates one embodiment of the present invention, garnish is blended in a dry state in blending equipment 10 and delivered in measured quantities to individual cans by filling device 12. Normally the amount of garnish placed in each can accounts for less than half the volume of the can. A small quantity of water may be added to the can from a water source 14. The amount of water added to the can will depend on the nature of the product and the nature of the subsequent processing steps. For most garnish products the primary reason for adding water is to provide a source of steam to aid in the subsequent sterilization step. As described below, heating of a sealed container will result in flashing of the added water to steam. Operation of the process of the present invention in this manner requires only a small amount of water addition. For example, in a 211×400 size can (310 gram weight) containing about 124 grams of garnish, water additions of about 8–10 grams usually are satisfactory to achieve the stated objective. Some carbohydrate-containing products, such as beans and pastas, undergo rehydration reactions during cooking. By varying the amount of added water placed in the container according to the present invention, it is possible to closely control the degree of rehydration that takes place during garnish sterilization. Thus, products can be provided having the hydration characteristics of freshly cooked products. Water additive amounts may also be controlled with a view toward protecting the garnish from excessive physical damage during sterilization. Some forms of can sterilization such as rotary cookers subject the can to tumbling or rolling action. Some types of garnish may be damaged unless the sealed container also contains a substantial amount of liquid to cushion the shock to the garnish. In accordance with this embodiment, it is desirable to add larger amounts of water, i.e., up to filling the remainder of the container volume not occupied by the garnish. After sterilization of the garnish this excess water may be drained from the can, if desired.

After the garnish and water, if any, has been added to the container, the container is then temporarily sealed, preferably under vacuum conditions, by sealing equipment 16. It is preferred to evacuate air from the cans prior to processing in order to prevent discoloration from occurring and also to avoid excessive internal pressure within the can during the heating. Included air additionally will act as an insulating medium and thus cause reduced heat penetration efficiency. Typical vacuum conditions in the can may be on the order of about 1 to 25 inches Hg., and preferably 5 to 15 inches of Hg.

The cans containing garnish and water are then heat sterilized in any suitable sterilizing apparatus 18. In a preferred form this sterilizing apparatus can comprise a rotary continuous cooker. Other types of conventional can sterilizing equipment may also be employed for this step.

The conditions of sterilization are preferably those conducted under high temperature and short time process parameters. In general, the sterilization of the garnish follows the conventional time-temperature relationships for all canned food products. Although these conditions will vary depending on the nature and amount of garnish and possibly water in the can, typical processing temperatures in the range of from about 240° to 300° F. and preferably about 250° to 280° F. can be satisfactorily employed. Because the cans are generally less than half full of garnish, the can presents a reduced thermal load and better heat transfer properties. Accordingly, very short heating times, i.e., on the order of about 4 to 60 min., preferably about 8 to 20 min., can be utilized in the process of the present invention. Although lower temperature sterilization procedures for longer times may be employed in this step, high temperature short time conditions are preferred for their minimal alteration of physical and flavor characteristics of the garnish.

As is known in the food processing art, some acid food products can be effectively sterilized at somewhat lower temperatures in the range of about 180° to 190° F. Sometimes termed pasteurization, this treatment is effective to kill yeasts, molds and bacteria and, as long as the pH of the product remains below about 4.5, pathogenic spores will not germinate. This type of sterilization treatment may be used in the process of the present invention as long as the pH requirements (i.e., below 4.5) are maintained even after addition of the separately sterilized liquid component.

Cans leaving the sterilizer 18 pass directly into the aseptic zone 19 which is maintained under aseptic and preferably pressurized conditions. The lids are removed at station 20 and aseptically sterilized broth is added to the cans through a broth filler 22. Besides aiding in maintaining a sterile environment, over-pressure at the broth filling station also prevents the contents of the can from flashing when the can is opened. In cases where the solid component temperature is less than about 210° F. when the container is opened, flashing is not a serious problem and the sterile atmosphere need not be pressurized. The nature of the atmospheric environment in the aseptic zone may vary depending on the design of the equipment utilized. In general, pressures of from about 15 to 60, and preferably about 20 to 35 psig are effective to facilitate aseptic conditions and prevent flashing. The atmosphere may conveniently be a steam atmosphere, although sterile air (incinerated or filtered) or inert gases may be employed in a known manner. In those systems in which asepsis is maintained by the sterility or chemical nature of the atmosphere, rather than its temperature, lower temperatures may, of course, be used, as long as care is taken to minimize flashing over the hot garnish-containing cans.

Before being added to the cans at filling station 22, the broth is first blended in mixing equipment 24, sterilized in sterilizer 26 and aseptically chilled in a chiller 28 which can operate according to any of a number of commonly used heat exchange principles, such as flashing or indirect heat exchange. The temperature to which the broth is chilled can vary significantly depending on the type of equipment employed, the nature and temperature of the garnish to be combined with the broth and the provision, if any, for later cooling of the sealed cans. In general, the chiller should bring the temperature of the broth to a value below that of the hot garnish to effect a rapid quenching of the garnish. Substantial thermal damage to garnish during heat sterilization typically occurs during the long cool-down period which is present in continuous processes. Cooling the can is expensive, for the heat energy is not efficiently neutralized. By using the cooled broth to quench the garnish, this cooling takes place rapidly enough to avoid thermal degradation and improves the economics of cooling. In the preferred embodiment the cooling should be sufficient to bring the final composite canned product down to a temperature in the range of from about 100° to 210° F., and preferably about 110° to 115° F. At the preferred values little, if any, further cooling of the can is required. Of course, if can cooling is necessary or desirable for any other reason, it is not necessary to cool the broth down as much.

The can is then passed to a sealing station 30, where a sterile lid is sealed on each filled can. The cans may then be water or air cooled, if necessary, at a cooling station 32.

Aseptic sterilization of the broth in sterilizer 26 may be accomplished in any suitable manner. Preferably, high temperature short time conditions followed by a rapid cool-down should be used to prevent any unnecessary thermal degradation of the broth. Examples of suitable processes are direct steam infusion or injection, or indirect exchange in a thin film, swept surface, or other type of heat exchanger. The parameters of heating will depend on the nature of the product being sterilized and on the type of equipment being employed. For example, the temperature conditions to which a product can be subjected will be determined by desired final product characteristics, the sensitivity of the liquid product to thermal degradation, the product viscosity, and the like. In general, the normal time-temperatures regimens necessary to kill the requisite number of organisms can be determined in a known manner. In addition, longer heating times may be required to ensure the deactivation of enzymatic systems that deleteriously affect the product stability. Typically, product sterilization temperatures of from about 265° to 300° F. can be satisfactorily employed for most liquid products. In general, times of from about 1 to 100 seconds are preferred, although somewhat longer or shorter times may be employed for certain products. In a direct heat exchange sterilization process, for example, typical temperatures and mean residence times to effect commercial sterility are 270° F. at 7 seconds, or 300° F. at 1.4 seconds.

Figure 2:
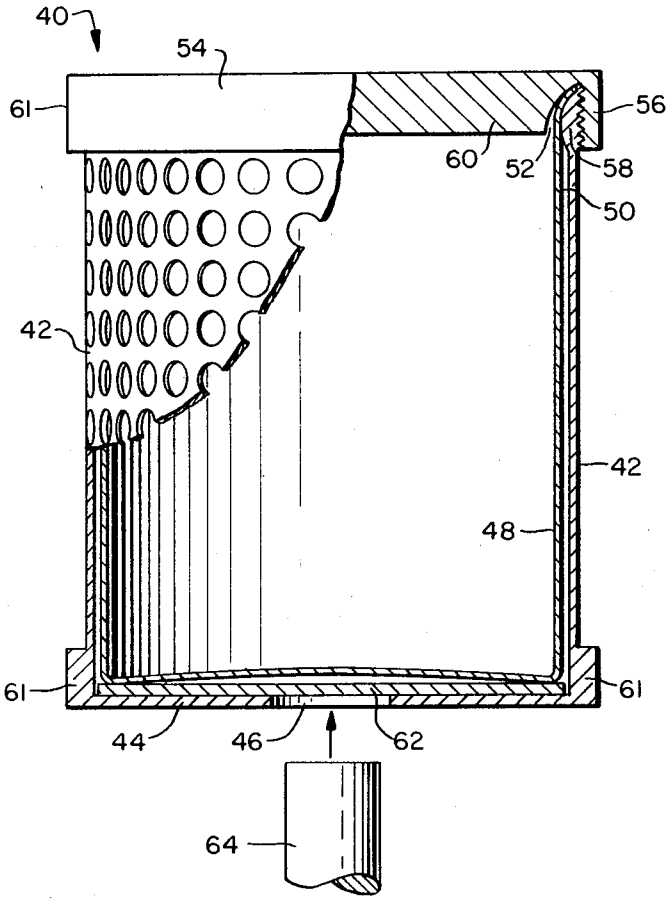
FIG. 2 is an elevational view in section of the processing chamber and a container housed therein.

FIG. 2 depicts one of many processing chambers, 40 for handling an individual can during the sterilizing and packaging process. The chamber comprises a cylindrical, substantially rigid side wall 42, preferably foraminous, joined to a bottom wall 44 which preferably also is foraminous. Bottom wall 44 has a central aperture 46 for a purpose described below. Processing chamber 40 is dimensioned so as to receive and snugly surround a can 48 which is inserted through the open upper end 50 of the chamber. The open upper end 52 of can 48 is substantially coplanar with the open upper end 50 of chamber 40. Both chamber 40 and can 48 are closed by a removable lid 54 having a depending, internally threaded annular lip 56 which mates with a threaded portion 58 on the exterior of sidewall 42. A central tapered projection 60 on the underside of lid 54 matingly seals with the inner margins of the upper end of can 48. A movable false bottom 62 is retained within chamber 40. During final sealing of the can, a driven ejection mechanism 64 travels upwardly through aperture 46 and raises false bottom 62 and can 48 to partially eject can 48 from chamber 40 so that its open upper end 52 can be freely sealed by the application of a sterile lid. Radially projecting rolling rings 61 are provided on lid 54 and the bottom of side wall 42 to permit chamber 40 with can 48 to roll along guides in cooker 18.

Processing chamber 40, lid 54 and false bottom 62 may be fabricated of any suitable sanitary material which will withstand the high temperatures of sterilization. Stainless steel and certain high temperature plastics, for example, would be suitable for this purpose. The function of the lateral wall 42 of chamber 40 is to provide lateral support for the wall of the can, which may tend to bulge under internal pressure generated during sterilization. In the preferred embodiment the apertures in the walls of chamber 40 permit the heating medium to come into direct contact with the walls of can 48, thereby maximizing heat transfer to the can and its contents. Because processing chamber 40 provides this lateral support for the can, cans made of thinner gauge material can be used, resulting in reduced manufacturing and transportation costs. Suitable mechanisms, well known to those skilled in the art, are used to synchronously apply and remove lid 54, and actuate ejection mechanism 64. These mechanisms may derive their power from the continuously operating conveyor system which carries processing chambers 40 through the system.

The process and apparatus of the invention are suitable for sterilizing and packaging a wide variety of food products. The following is only a partial list of these products:

beans
pasta
chunky soups
stews
meat dumplings
Chinese foods
condensed soups
pancake batter
chunky spaghetti sauce
meatballs
fruit pie filling
fruit desserts
yogurt with fruit
fruit salads The ratio of liquid to garnish in the products according to the present invention may vary widely depending on the nature of the product. In general, ratios of from about 4:1 to 1:1 can be used. For example, the liquid to garnish ratio for a few selected products is set out below:

beans: 1:1
chunky soups: 3:2
puddings: 4:1

Figure 3:
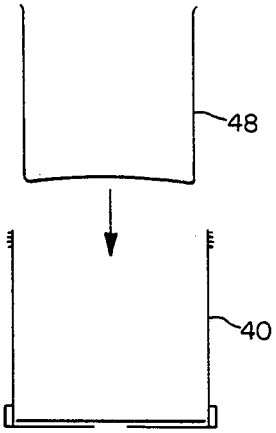
FIGS. 3–10 schematically illustrate the sequential steps involved in the process in handling the container in which the product is ultimately sealed.
Figure 4:
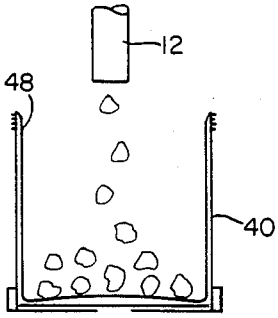
Figure 5:
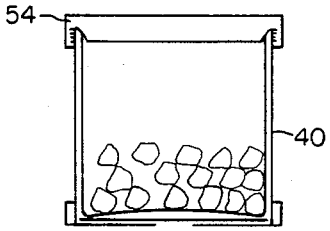
Figure 6:
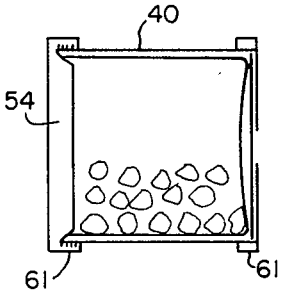
Figure 7:
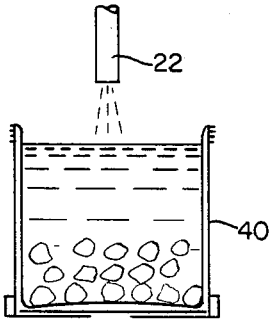
Figure 8:
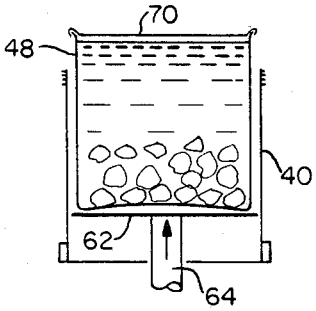
Figure 9:
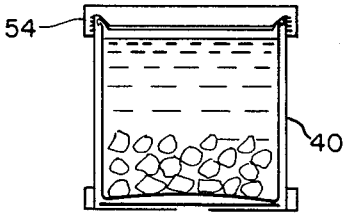
Figure 10:
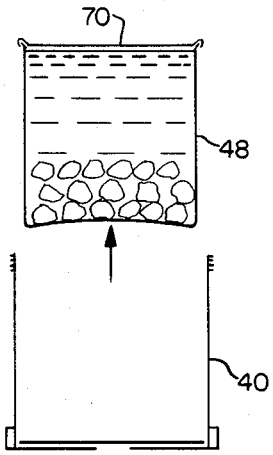

FIGS. 3–10 schematically illustrate the sequential operations which processing chamber 40 and can 48 undergo during the sterilization and packaging process of FIG. 1. An open-ended can 48 is inserted into an open-ended chamber 40 (FIG. 3). Garnish is then placed into can 48 from garnish filler 12 (FIG. 4). Lid 54 is then applied, sealing the open upper end of can 48 (FIG. 5). The sealed assembly with garnish inside then travels through continuous cooker 18 by rolling on its rolling rings 51. After leaving the cooker, lid 54 is removed and the can is filled with sterilized broth from broth filler 22 (FIG. 7). Ejecting member 64 then elevates false bottom 62 and can 48 to free the upper end 52 of the can and permit the application of a permanent sterile lid 70 at sealing station 30 (FIG. 8). Lid 54 is then reapplied (FIG. 9), and the chamber and can are carried from the aseptic processing environment to a location where lid 54 is removed, and filled and sealed can 48 is withdrawn (FIG. 10).

It is evident that numerous advantages are inherent in the process and apparatus of the invention. Where rehydration of the garnish is desired during sterilization (such as with bean, rice or pasta garnish), the extent of rehydration can be precisely controlled yielding firmer texturized garnish with superior product identity and appearance. In general, garnish distribution and uniformity of products according to the invention is improved along with appearance, wholeness and texture. The process of the present invention also eliminates the need for starches or thickeners which would otherwise be needed for suspending the garnish during blending and filling. As a result, improvements in flavor, texture and cost can be achieved. Also, the leaching during processing of starch and solubles from the garnish into the broth is greatly reduced, which results in more natural tasting finished products. Where tomato-containing sauces are being processed, undesirable emulsification is reduced, thereby reducing color loss and minimizing cloudiness of the broth.

The process permits rapid heat penetration and sterilization of the garnish, thus substantially shortening the required processing cycle. In addition, very rapid, almost instantaneous cooling of the particulate garnish can be accomplished immediately upon reaching the desired °F. value. Thus, thermal degradation which normally occurs during standard retort cooling is eliminated.

Because the liquid and solid components of the product are sterilized separately and independently of each other, the exact time and temperature required for sterilization of each can be employed. This produces a finished product with each component having its own identity, unlike other heat sterilized products where flavors and textures are indistinguishable.

The process of the present invention possesses the further advantages of utilizing existing filling, sealing, heat processing and aseptic sterilizing equipment with only minor technical modifications. The process is a continuous one at can speed comparable with standard systems. Cooling equipment and space requirements are greatly reduced. Primary cooling is done in the aseptic liquid component, which permits energy recovery and improved efficiency. Adding chilled broth to the can cools the entire product before sealing, thus avoiding the thermal shock and stress that occurs in the seam areas in standard heat processing. This greatly reduces the incidence of leaks and cooling water contamination and associated spoilage problems. This factor also will permit new designs of easy opening lids for both cans and jars, such as pull tabs and flexible film closures. Product and packaging appearance is conventional and familiar to consumers. Alternative and less expensive forms of packaging can be employed, such as thin gauge sheet metal, aluminum, glass, retort pouch and high temperature resistant plastics.

It will be obvious to one of ordinary skill that numerous changes and modifications may be made without departing from the true spirit and scope of the invention, which is to be limited only by the appended claims. For example, other devices may be used to temporarily seal cans and sterilize the garnish component therein. One example of such an arrangement is the use of a lid with a pre-cut hole approximately $\frac{1}{8}$ inch in diameter. Heat sterilization of the container contents in a pressurized steam environment can be accomplished either on a continuous or batch basis under sanitary conditions. The hole might be temporarily plugged utilizing a rubber or similar stopper device. After processing, filling of aseptically sterilized and chilled broth can be accomplished by a needle nose injector inserted into the pre-cut hole. The opening is then sealed by solder, organic cement, pull tab tape, welded or lacquer film-sealed. Possible modifications for the apparatus of the preferred embodiment are the use of a snap-on, rather than a screw-on lid 54 for the processing chamber, or the use of an elastic lid clamp for temporarily holding an unseamed lid in place. Where glass containers, rather than cans are used, a tempering step should be performed before quenching with chilled broth to prevent thermal shock and consequent breakage. Further modifications will be readily apparent to those skilled in the art.

The following examples are intended to illustrate more fully the nature of the present invention without acting as a limitation on its scope.

EXAMPLE 1

This example demonstrates the preparation of a canned bean product according to the present invention. Component A (garnish) of this formulation consists of 153 grams of blanched beans. Component B of this formulation consists of 165 grams of the following sauce:

COMPONENT B (SAUCE)

Molasses
Prepared mustard
Ketchup
Burnt sugar
Starch
Cider vinegar
Salt
Sugar
Tomato paste
Lard
Bacon ends
Spices and flavorings Component A of the formulation along with 12 grams of a 1% NaCl solution is added to a 211×400 can. After temporarily sealing, the can is subjected to heat sterilization in a continuous rotary cooker for 11 minutes at 270° F. with the cooker operating at a speed of 7.18 seconds per revolution. The B component (sauce) is separately sterilized and filled into the can containing sterilized beans under aseptic conditions. The resulting product is characterized by excellent garnish and sauce integrity and significantly improved flavor and texture of the composite.

EXAMPLE 2

This example demonstrates the preparation of a canned chicken gumbo product according to the present invention. Components A and B of this formulation comprise the following:

COMPONENT A (GARNISH)

Fresh diced celery ($\frac{3}{8}\times\frac{3}{8}$")
Okra
Diced tomatoes
Rice (blanched)
Chicken meat ($\frac{3}{8}\times\frac{3}{8}$)
Fresh chicken fat
Fresh green peppers ($\frac{1}{4}\times\frac{1}{4}$)

COMPONENT B (BROTH)

Chicken stock
Tomato paste
MSG
Salt
Hydrolized vegetable protein
Burnt sugar
Corn syrup
Mechanically deboned chicken meat
Starch
Spices and flavorings
Water 123 grams of the component A garnish is added to a 211×400 can along with 8 grams of water. The can containing the garnish component is then temporarily sealed and heated at 250° F. for 15 minutes in a stationary retort. The retorted can is opened in an aseptic environment wherein 184 grams of separately sterilized component B broth is filled into the can. The resulting product is characterized by a garnish fraction in which the components retain their individual flavors and textures.

EXAMPLE 3

This example demonstrates the preparation of a canned product comprising vegetables in cream sauce (succotash) according to the present invention. 140 grams of component A dry "succotash vegetables" (corn and lima beans) along with 5 grams of water is placed in a 211×400 can. This can is sealed and sterilized in rotating cooker for 8 minutes at 270° F. and a speed of 3 revolutions per minute. 165 grams of the following separately sterilized component B sauce is added to the can under aseptic conditions:

COMPONENT B (CREAM SAUCE)

Milk powder
Margarine
Vegetable oil
Salt
MSG
Starch
Wheat flour
Spices and flavorings
Water The resulting product is permanently sealed under aseptic conditions and cooled in the can. This product is characterized by good sauce integrity and flavor and vegetables of better flavor and texture.

EXAMPLE 4

This example demonstrate the preparation of a canned pudding product according to the present invention. 60 grams of fresh pineapple chunks (component A) is added to a 211×400 can and is temporarily sealed therein with 5 cc of water. The sealed can is then retorted at 270° F. for 8 minutes in a rotary cooker operating at a speed of 3 revolutions per minute. The can is then filled with the following separately aseptically sterilized component B under aseptic conditions and the can is sealed.

COMPONENT B (PUDDING)

Sugar
Powdered milk solution
Margarine
Bakers colored margarine
Starch
Vanillin

The resulting fruit-containing pudding is characterized by excellent flavor and good component integrity.

EXAMPLE 5

This example demonstrates the preparation of a tomato rice soup product according to the present invention. Component A (garnish) consists of blanched rice and diced tomatoes. 105 grams of this material is added along with 5 grams of a 1% NaCl solution to a 211×400 can and temporarily sealed under vacuum conditions. The sealed can is then retorted at 250° F. for 15 minutes in a stationary retort. The retorted can is then opened and 194 grams of the following separately aseptically sterilized sauce (component B) is added to the can under aseptic conditions:

COMPONENT B

Tomato paste
Vegetable oil
Enzyme cheese
Salt
Sugar
Citric acid
Ascorbic acid
Wheat flour
Spices and flavorings
Water The resulting product is characterized by excellent flavor and texture for each of the components.

EXAMPLE 6

This example demonstrates the preparation of a canned cream of asparagus product according to the present invention. Component A of this product comprises asparagus tips. 33.2 grams of asparagus tips is added to a 211×400 can along with 8 grams of a 1% NaCl solution. The can is then temporarily sealed and retorted at 250° F. for 20 minutes in a stationary retort. 267 grams of separately aseptically sterilized cream sauce (component B below) is added to the can under aseptic conditions and the can is permanently sealed.

COMPONENT B

Sweet whey
Wheat flour
Starch
MSG
Salt
Sugar
Asparagus pulp
Margarine
Spices and flavorings
Water The resulting product is noticeably better in texture and flavor than standard formulations processed conventionally.

EXAMPLE 7

This example demonstrates the preparation of a canned chunky chicken-rice soup product according to the present invention. Component A of this product comprises the following:

COMPONENT A (GARNISH)

Carrots ($\frac{3}{8}\times\frac{3}{8}\times\frac{1}{2}$)
Celery ($\frac{1}{2}\times\frac{3}{4}\times\frac{1}{2}$)
Chicken meat ($\frac{3}{4}\times 1$)
Rice (blanched)

Component B, the broth, comprises the following:

COMPONENT B (BROTH)

Chicken fat
Chicken stock
Salt
MSG
Hydrolized vegetable protein
Spices and flavorings
Corn starch
Potato starch
Water 219 grams of the garnish component A is placed in a 303×500 can with 8 grams of a 1% NaCl solution and the can is temporarily sealed under vacuum conditions. The can is placed in an outer processing chamber of the type shown in FIG. 2, temporarily sealed with the chamber lid and subjected to retorting at 250° F. for 15 minutes in a stationary retort. 318 grams of the broth (component B) is separately aseptically sterilized and cooled and is added, under aseptic conditions, to the can after the chamber lid is removed. A permanent lid is then sealed onto the can and the can is removed from the chamber and air cooled. The resulting product is markedly superior in flavor and texture to the standard product processed conventionally.

EXAMPLE 8

This example demonstrates the preparation of a canned chop suey product according to the present invention. 159 grams of component A of this product—Chinese vegetables—is combined with 5 grams of water and temporarily sealed in a 211×400 can. This can is retorted at 270° F. for 8 minutes in a rotary cooker operating at 3 revolutions per minute. The following butter sauce (component B) is separately aseptically sterilized, and 136 grams is aseptically filled into the cans after opening in the aseptic environment.

COMPONENT B (SAUCE)

Salt
Ground ginger
MSG
Sugar
Soy sauce
Starch
Margarine

The can is then sealed permanently. The resulting product is characterized by excellent flavor and texture when compared to standard products processed conventionally.

While certain specific embodiments of the invention have been described with particularity herein, it will be recognized that various modifications thereof will occur to those skilled in the art. Therefore, the scope of the invention is to be limited solely by the scope of the appended claims.

I claim:

1. A method for sterilizing and packaging a product having solid and liquid components, comprising the steps of:

(a) placing the unsterilized solid component into a container in which the product is ultimately sealed;
(b) temporarily closing the container;
(c) heating the contents of the container to effect sterilization thereof;
(d) opening the container in a sterile environment, to prevent contamination of the contents;
(e) filling the container in said sterile environment with aseptically sterilized liquid component which is cooler than the solid component to quench the hot solid component; and
(f) sealing the filled container in said sterile environment.

2. A method for sterilizing and packaging a food product having solid garnish and liquid components, comprising the steps of:

(a) placing the unsterilized solid component and a small quantity of water into a container in which the product is ultimately sealed;
(b) temporarily closing the container;
(c) heating the contents of the container to flash the water to steam and effect sterilization of the contents;
(d) aseptically sterilizing and then cooling the liquid component;
(e) opening the container in a pressurized, sterile environment, to prevent contamination and flashing of the contents;
(f) filling the container in said environment with the sterilized liquid component which is cooler than the solid component to quench the hot solid component; and
(g) sealing the filled container in said environment.

3. A method for sterilizing and packaging a product having solid and liquid components, comprising the steps of:

(a) placing an open-ended container in which the product is ultimately sealed into a close-fitting, open-ended processing chamber;
(b) placing the unsterilized solid component into the container;
(c) capping the processing chamber with a lid which temporarily closes the open end of the container;
(d) heating the contents of the container to effect sterilization thereof;
(e) removing the lid in a pressurized, sterile environment, to prevent contamination and flashing of the contents;
(f) filling the container in said environment with aseptically sterilized liquid component which is cooler than the solid component to quench the hot solid component;
(g) sealing the filled container in said environment.

4. A method according to claim 1 or 3 further comprising the step of adding a small quantity of water to the container with the unsterilized solid component, which flashes to steam to sterilize the contents when heated.

5. A method according to claim 1, 2 or 3 wherein the step of temporarily closing the container comprises sealing the container under conditions which create a vacuum in said container.

6. A method according to claim 5 wherein the heating step comprises immersing the entire container in a heating medium.

7. A method according to claim 6 wherein the container is heated under high temperature short time conditions.

8. A method according to claim 2 wherein the step of aseptically sterilizing the liquid component comprises heating the liquid component under high temperature short time conditions.

9. A method according to claim 3 comprising the further steps of reapplying the lid to the processing chamber after the container is sealed, removing the chamber and container from the pressurized, sterile environment, removing the lid from the chamber, and removing the sealed container from the chamber.

10. A system for sterilizing and packaging a food product having solid and liquid components, comprising:

(a) means for inserting the unsterilized solid component into the container in which the product is ultimately sealed;
(b) means for temporarily sealing and handling said container during immersion thereof in sterilizing zone containing a heating medium in which the container and its contents are sterilized;
(c) means for aseptically sterilizing the liquid component;
(d) means for cooling the aseptically sterilized liquid component;
(e) means for aseptically filling the sterilized container in sterile environment with sterilized and cooled liquid component to quench the hot solid component; and (f) sealing means for permanently sealing the filled containers.

11. A system for sterilizing and packaging a food product having solid and liquid components, ultimately sealed in a container which initially has an open end, comprising:

(a) a solid component sterilization zone containing a heating medium in which the container containing the solid component is immersed to sterilize the container and its contents;

(b) means for inserting the solid component into the container;

(c) means for temporarily sealing and handling the container during immersion thereof comprising:

(1) an open-ended, substantially rigid, foraminous processing chamber dimensioned to receive and closely surround the container to provide support therefor, yet allow the heating medium to contact the walls thereof; and (2) removable lid means for temporarily closing the open end of the chamber and sealing the open end of the container;

(d) means for aseptically sterilizing the liquid component;

(e) means for aseptically cooling the sterilized liquid component;

(f) means for aseptically filling the sterilized container in a positive pressure environment with sterilized and cooled liquid component to quench the hot solid component; and (g) sealing means for sealing the filled container with a permanent lid.

12. In a system for aseptically sterilizing and packaging a product having solid and liquid components, ultimately sealed in a container which initially has an open end, comprising a solid component sterilization zone containing a heating medium in which the container containing the solid component is immersed to sterilize the container and its contents, an apparatus for temporarily sealing and handling the container during immersion thereof comprising:

(a) an open-ended, substantially rigid, processing chamber dimensioned to receive and closely surround the container to provide support therefor;

(b) removable lid means for temporarily closing the open end of the chamber and sealing the open end of the container; and (c) an aperture in the bottom of the chamber, opposite the open end thereof, adapted to receive pusher means for partially ejecting the container from the chamber to facilitate application of a permanent lid to the open end of the container after the lid means has been removed and sterilized liquid component added to the container.

13. For use in a system for heat treating a component of a product under pressure in an open-ended container in which the product is ultimately sealed, but before introduction of the other components of the product, an apparatus for temporarily sealing the handling the container thereof in a heating medium comprising:

(a) an open-ended, substantially rigid, foraminous processing chamber dimensioned to receive and closely surround the container to provide support therefor yet allow the heating medium to contact the walls thereof;

(b) removable lid means for temporarily closing the open end of the chamber and sealing the open end of the container; and (c) an aperture in the bottom of the chamber, opposite the open end thereof, adapted to receive pusher means for partially ejecting the container from the chamber to facilitate application of a permanent lid to the open end of the container after all components of the product have been inserted.

14. Apparatus according to claim 11, 12 or 13 wherein the chamber and the container are substantially cylindrical.

15. Apparatus according to claim 14 wherein the lid means comprises a central tapered projection sized to fit within the open end of the container and seal against the inner surface of the cylindrical wall thereof.

16. Apparatus according to claim 15 wherein the lid means has an annular depending flange at its periphery surrounding said tapered projection with screw threads on its inner surface, and the chamber has mating screw threads on its exterior to hold the lid means in position sealing the container.

17. Apparatus according to claim 14 wherein mating portions of the chamber and lid means are matingly screw threaded to hold the lid means in position sealing the container.

18. Apparatus according to claim 14 wherein the chamber with container and lid means is conveyed through the heating medium by being rolled along guide means, the lid means and the bottom end of the cylindrical wall of the chamber each having a circumferential shoulder projecting radially beyond the cylindrical wall of the chamber to form a rolling ring on which the chamber rolls along the guide means.

19. A system according to claim 10 or 11 wherein said sealing means comprises ejection means for partially ejecting the filled container from the chamber to facilitate application of a permanent lid to the container.

20. A system according to claim 19 wherein said ejection means comprises an aperture in the bottom of the chamber, opposite the open end thereof, and pusher means projectable into the chamber through said aperture to partially eject the container and expose its open end.

21. Apparatus according to claim 12, 13 or 20 wherein said processing chamber further comprises a movable bottom plate covering said aperture on which the container rests and which is contacted by said pusher mechanism to partially eject the container.

* * * * *